United States Patent [19]

Ludlow

[11] Patent Number: 5,016,552

[45] Date of Patent: May 21, 1991

[54] BOAT HULL

[76] Inventor: Roy S. Ludlow, 3045 West 2100 S., Salt Lake City, Utah 84104

[21] Appl. No.: 152,879

[22] Filed: Feb. 5, 1988

[51] Int. Cl.[5] ..... B63B 1/32

[52] U.S. Cl. ..... 114/56; 114/290; 114/355

[58] Field of Search ..... 114/56, 290, 288, 62, 114/355

[56] References Cited

U.S. PATENT DOCUMENTS

| | | | |
|---|---|---|---|
| 1,050,517 | 1/1913 | Chase | 114/290 |
| 3,077,172 | 2/1963 | Dornak | 114/62 |
| 3,226,739 | 1/1966 | Noe | 114/56 |
| 3,330,239 | 7/1967 | Dornak | 114/56 |
| 3,902,445 | 9/1975 | Stolk | 114/62 |
| 4,004,542 | 1/1977 | Holmes | 114/56 |
| 4,348,972 | 9/1982 | Parsons | 114/56 |
| 4,392,448 | 7/1983 | Shirley | 114/56 |
| 4,478,166 | 10/1984 | Sorensen | 114/290 |
| 4,672,905 | 6/1987 | Pipkorn | 114/290 |
| 4,702,188 | 10/1987 | Harilainen | 114/56 |
| 4,813,365 | 3/1989 | Lindstrom et al. | 114/56 |

FOREIGN PATENT DOCUMENTS

| | | | |
|---|---|---|---|
| 226389 | 10/1986 | Japan | 114/56 |

*Primary Examiner*—Joseph F. Peters, Jr.
*Assistant Examiner*—Thomas J. Brahan
*Attorney, Agent, or Firm*—M. Reid Russell

[57] ABSTRACT

A boat hull having inner ribs and outer chines interconnected by an inverted V-shaped planer surface and with the ribs and outer chines being pronounced at both sides of the stern of the hull and gradually disappearing as they converge and form strakes extending towards the bow of the hull. With the keel of the hull as level, the outer chines extend downwardly from the hull to be below the outermost extremities of the ribs.

1 Claim, 2 Drawing Sheets

BOAT HULL

BRIEF DESCRIPTION OF THE INVENTION

1. Field of the Invention

This invention relates to boat hulls and particularly to hulls used on smaller type pleasure craft in the sixteen to forty foot centerline categories.

2. Prior Art

A great many hull constructions have been proposed for boats, and particularly for pleasure boats having centerline dimensions of between sixteen and forty feet in length. Because of the riding and handling characteristics it exhibits even in rough water and because of its ability to plane reasonably quickly when starting and to maintain plane reasonably well even at low speeds, the V-hull has long been one of the most popular designs for the hulls of boats in the specified size range.

Tri-hull designs have also enjoyed some degree of popularity, generally because of the stability they exhibit even when the loads they carry, i.e., people and goods, are shifting from side-to-side. The tri-hull generally is more stable in response to changing loads than is the V-hull and also in response to quick turns. However, the tri-hull while fairly effective at quickly planing, when started, and of maintaining plane, is generally subject to serious bouncing, even in moderately rough water, and does not steer well in even moderately rough water.

Tunnel hulls have also been used on pleasure type watercraft of the sizes under consideration. These hulls are considered advantageous in supporting the craft on plane and generally provide good stability in response to load changes within the craft. They are generally relatively slow to achieve plane.

There has remained a need for a boat hull that will exhibit a combination of good characteristics in steering, achieving plane, maintaining plane and load compensation.

OBJECTS OF THE INVENTION

Principal objects of the present invention are to provide a boat hull particularly adapted for pleasure craft in the sixteen to forty foot centerline range that will exhibit very good characteristics in steering, planing and load compensation.

Other objects are to provide a hull that will have an improved ability to quickly come out of the water and onto plane when started and that will remain on plane even at very low speeds.

Still other objects are to provide a boat hull exhibiting the usual V-hull riding characteristics but providing better turning and cornering and better stability under shifting load conditions than is achieved with conventional V-hulls.

FEATURES OF THE INVENTION

Principal features of the invention include a pair of chines forming continuations of a portion of the hull sidewalls and extending downwardly therefrom to a location below the lowermost extremity of inner ribs, spaced inwardly of the chines and a pair of planer surfaces interconnected to form an inverted V-surface connection between each set of chines, ribs and connection between planer surfaces each are most pronounced at the stern of the boat and are carried forward as strakes that converge from the transom beneath the hull while gradually disappearing into the sidewalls of the hull at the bow thereof.

Other objects and features of the invention will become apparent from the following detailed description and drawings disclosing what are presently contemplated as being the best modes of the invention.

THE DRAWING

In the drawing:

FIG. 1 is a side elevation view of the boat hull of the invention;

FIG. 2, a rear elevation view;

FIG. 3, a front elevation view; and

FIG. 4, a bottom plan view.

DETAILED DESCRIPTION

Figure 1:
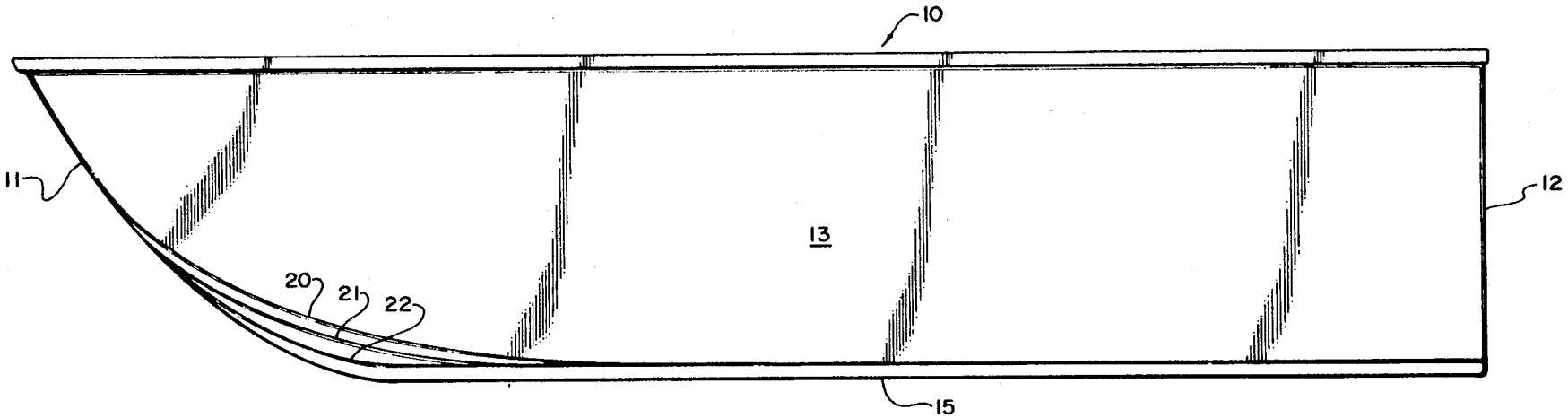
Figure 3:
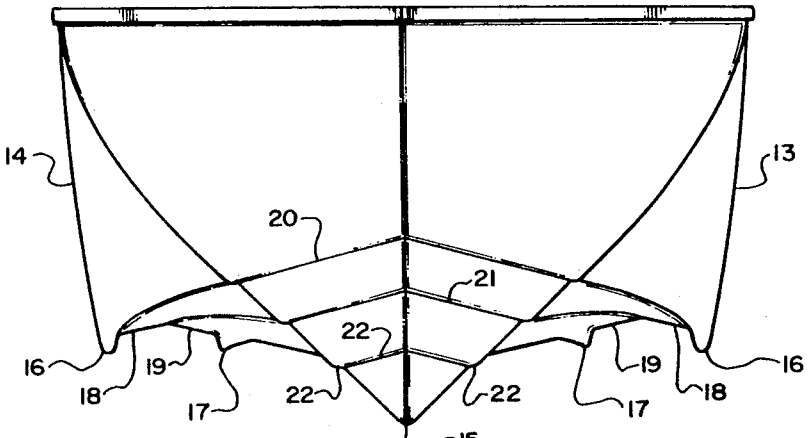
Figure 2:
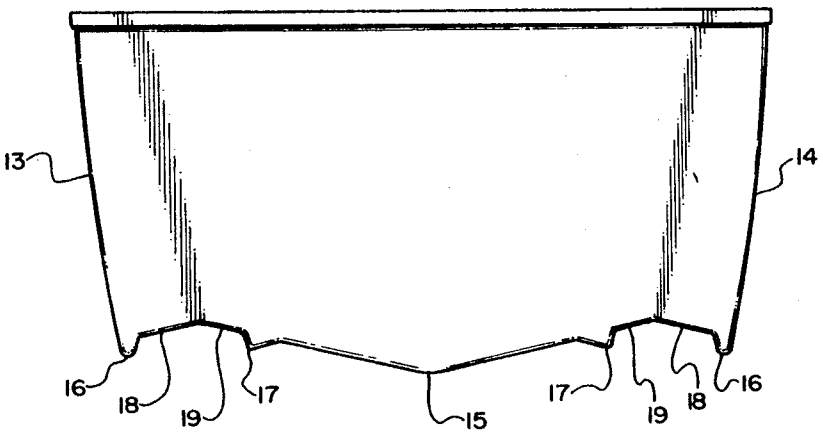
Figure 4:
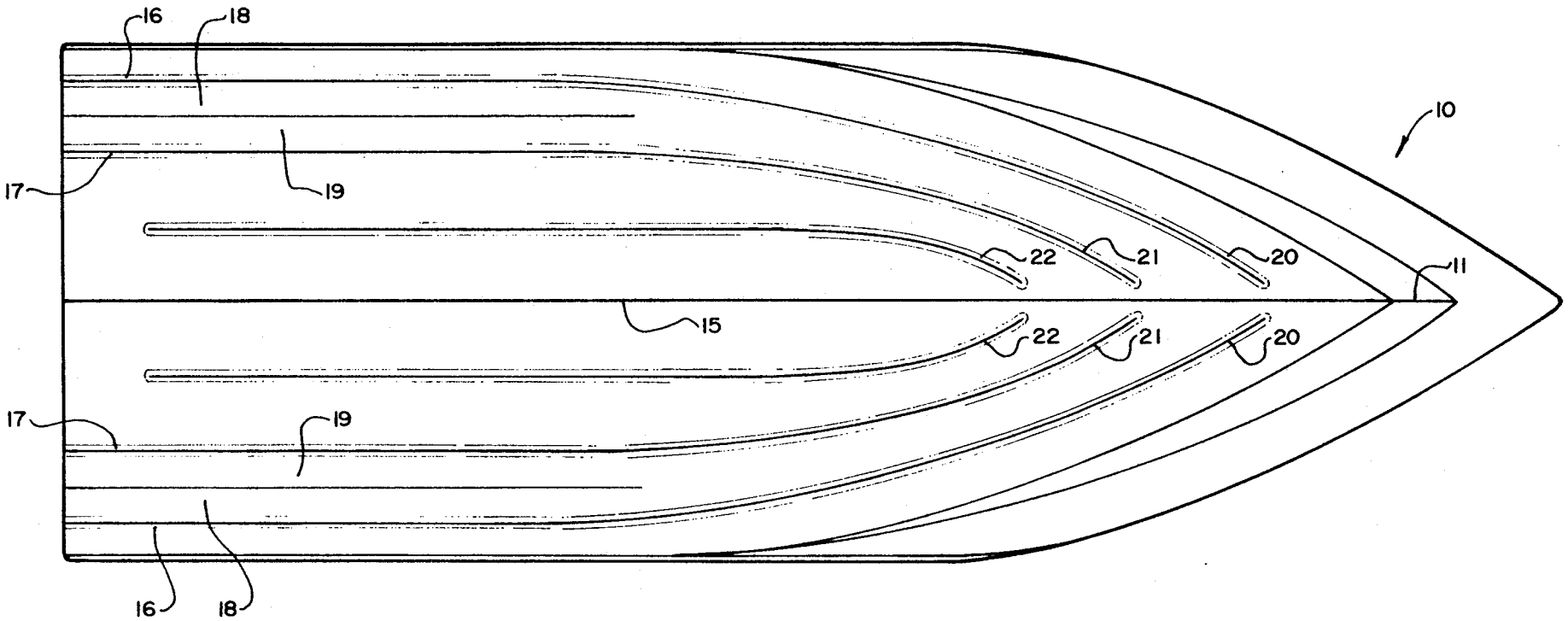

Referring now to the drawings:

In the illustrated preferred embodiment, the boat hull of the invention is shown generally at 10.

The hull 10, which is preferably made of fiberglass, or the like, includes the usual bow 11, stern 12, and sidewalls 13 and 14 that extend downwardly from a rim **14*a* to a keel 15** and from the stern inwardly to the bow.

Each sidewall 13 and 14 terminates at a lower edge in a chine 16 and each chine is connected inwardly of the sidewall to a rib 17 by a planer surface that at the rear of the hull is an inverted V-shaped planer surface made up of interconnected surfaces 18 and 19. The chines 16, when measured from the level keel, extend downwardly to at least even with and preferably slightly beyond the lowermost extension of the ribs 17.

The chines 16, ribs 17 and interconnected planer surfaces extend from the transom forwardly and the chines and ribs curve with the sidewall to respectively form strakes 20 and 21, at the forward part of the hull and curving into the upwardly curved bow 11. Similarly as the surfaces 18 and 19 extend forwardly from the stern the V-shape formed by the interconnected planer surfaces 18 and 19 becomes gradually less pronounced and disappears midway of the hull.

One or more additional strakes 22 may be incorporated into the hull.

It has been found that with the hull, as described, the comfortable riding and ready planing normally present with a V-hull is achieved. In addition, a quasi-tunnel hull action occurs between the chines and the ribs to further provide a comfortable ride and to assist in maintaining plane of the craft. Also, during turning of the craft, the chine and rib on the side in the direction of turn, are forced to "bite" into the water to increase drag on the side of the turn and to reduce the force necessary for turning and thus greatly increasing the maneuverability of the craft. It has also been found that the inverted V-shaped planer surfaces assist in the control of the craft and in maintaining an air layer.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A boat hull comprising, a stern; a pair of spaced apart sidewalls extending from the stern and converging to meet at a bow; a keel interconnecting the bow and the stern; a chine formed at a lowermost edge of each sidewall; a rib formed inwardly from each sidewall adjacent the stern and intermediate the keel and the chine formed on said sidewall and extending forwardly from the stern and merging into strakes that extend to proximate the bow; said chines for their full lengths, extend downwardly from each sidewall below the lower most extremities of said ribs when the keel is placed on level with said chines merging into strakes that extend to proximate the bow; and the surfaces between which chines and ribs are each an inverted V-shaped planar surface.

* * * * *